US008754819B2

(12) United States Patent
Li et al.

(10) Patent No.: US 8,754,819 B2
(45) Date of Patent: Jun. 17, 2014

(54) ANTENNA SYSTEM INCLUDING A CIRCULARLY POLARIZED ANTENNA

(75) Inventors: Qian Li, Ann Arbor, MI (US); Wladimiro Villarroel, Ypsilanti, MI (US)

(73) Assignee: AGC Automotive Americas R&D, Inc., Ypsilanti, MI (US)

( * ) Notice: Subject to any disclaimer, the term of this patent is extended or adjusted under 35 U.S.C. 154(b) by 932 days.

(21) Appl. No.: 12/722,941

(22) Filed: Mar. 12, 2010

(65) Prior Publication Data

US 2011/0221652 A1 Sep. 15, 2011

(51) Int. Cl.
*H01Q 1/32* (2006.01)

(52) U.S. Cl.
USPC ..... 343/713; 343/860; 343/700 MS

(58) Field of Classification Search
CPC . H01Q 1/1271; H01Q 9/0414; H01Q 9/0457; H01Q 9/0428
USPC ..... 343/832, 850, 852, 860, 713, 700 MS, 343/711
See application file for complete search history.

(56) References Cited

U.S. PATENT DOCUMENTS

| | | | | |
|---|---|---|---|---|
| 4,843,400 | A | 6/1989 | Tsao et al. | |
| 5,223,848 | A * | 6/1993 | Rammos et al. | 343/700 MS |
| 5,270,722 | A * | 12/1993 | Delestre | 343/700 MS |
| 5,898,405 | A | 4/1999 | Iwasaki | |
| 6,166,692 | A | 12/2000 | Nalbandian et al. | |
| 6,259,407 | B1 | 7/2001 | Tran | |
| 6,342,867 | B1 | 1/2002 | Bell | |
| 6,421,023 | B1 | 7/2002 | Phelan | |
| 6,639,558 | B2 | 10/2003 | Kellerman et al. | |
| 6,717,549 | B2 | 4/2004 | Rawnick et al. | |
| 7,099,686 | B2 | 8/2006 | Ro et al. | |
| 7,253,770 | B2 | 8/2007 | Yegin et al. | |
| 7,259,721 | B2 | 8/2007 | Chang et al. | |
| 7,403,152 | B2 | 7/2008 | Gustafsson | |

(Continued)

FOREIGN PATENT DOCUMENTS

| | | | |
|---|---|---|---|
| EP | 1750328 | A2 | 2/2007 |
| JP | 09-219618 | A | 8/1997 |
| RU | 2258286 | C2 | 8/2005 |
| RU | 2368040 | C1 | 9/2009 |

OTHER PUBLICATIONS

Zhang Qian-Yue et al: "Bidirectional Circularly Polarized Microstrip Antenna Fed by Coplanar Waveguide," Antennas, Propagation, & EM theory, 2006. ISAPE '06. 7th International Symposium on IEE, PI. dated Oct. 1, 2006, 2 pages.

(Continued)

*Primary Examiner* — Dieu H Duong
(74) *Attorney, Agent, or Firm* — Howard & Howard Attorneys PLLC

(57) ABSTRACT

An antenna system includes a circularly polarized (CP) antenna for receiving and/or transmitting a circularly polarized RF signal. The CP antenna includes a pair of radiating patches each having an elongated shape. An elongated axis is defined along a longest length of each of the radiating patches. The elongated axes are disposed generally perpendicular to one another to generate the circular polarization. A coplanar waveguide feeding element is disposed between the radiating patches for feeding RF signals from and/or to the radiating patches via electromagnetic coupling. A width of the slot of the coplanar waveguide is varied to provide impedance matching of the CP antenna with a transmission line.

11 Claims, 10 Drawing Sheets

(56) References Cited

U.S. PATENT DOCUMENTS

| | | | | |
|---|---|---|---|---|
| 7,405,700 | B2 | 7/2008 | Duzdar et al. | |
| 7,471,248 | B2 | 12/2008 | Popugaev et al. | |
| 2006/0152422 | A1* | 7/2006 | Kubba et al. | 343/713 |
| 2007/0024511 | A1 | 2/2007 | Li et al. | |
| 2007/0216589 | A1 | 9/2007 | Li et al. | |
| 2008/0129619 | A1* | 6/2008 | Lee et al. | 343/713 |
| 2008/0238781 | A1* | 10/2008 | Su et al. | 343/700 MS |
| 2010/0171675 | A1* | 7/2010 | Borja et al. | 343/798 |

OTHER PUBLICATIONS

International Search Report for Application No. PCT/US2011/027202 dated Mar. 4, 2011, 4 pages.

English language translation and abstract for JP 09-219618 extracted from PAJ database, dated Jun. 7, 2010, 40 pages.

English language abstract for RU 2258286 extracted from the espacenet.com database on Jun. 10, 2013, 12 pages.

English language abstract for RU 2368040 extracted from the espacenet.com database on Jun. 10, 2013, 18 pages.

* cited by examiner

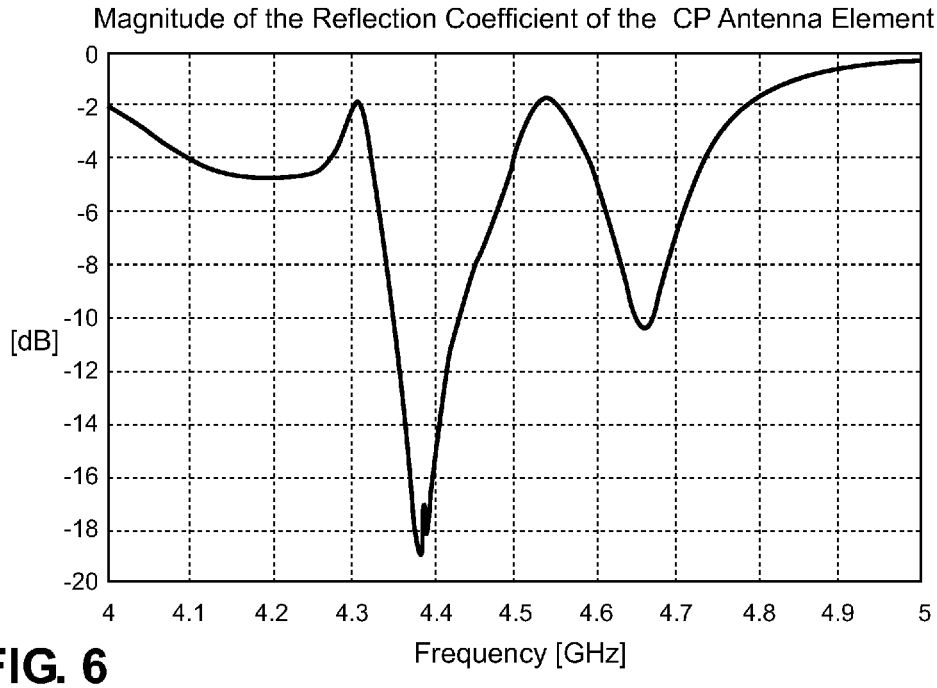
FIG. 6
FIG. 9
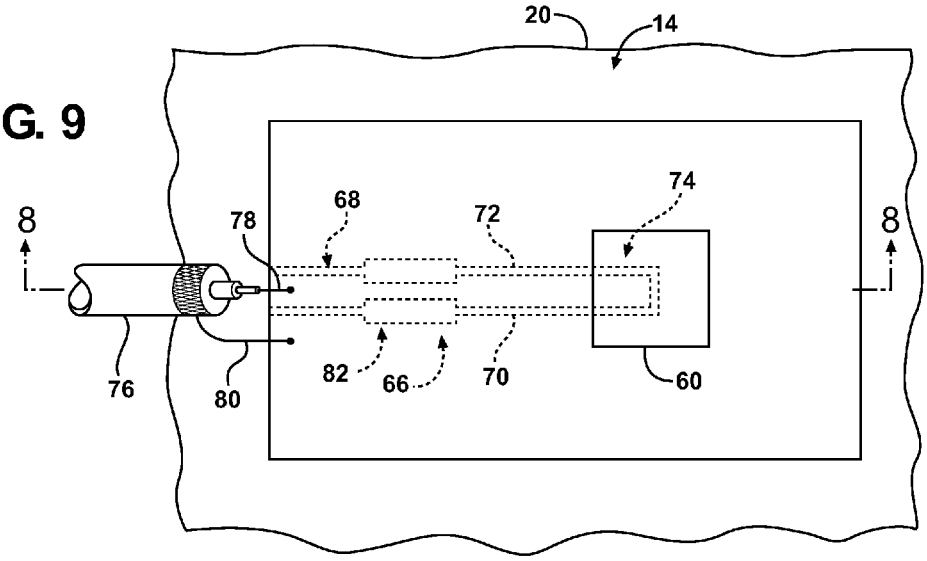

Elevation Pattern CP Gain
(dBi)

Elevation Pattern LP Gain
(dBi)

ANTENNA SYSTEM INCLUDING A CIRCULARLY POLARIZED ANTENNA

BACKGROUND OF THE INVENTION

1. Field of the Invention

The subject invention relates to an antenna system. More specifically, the invention relates to a circularly polarized antenna for use with the system.

2. Description of the Related Art

Motor vehicles have traditionally been equipped to receive RF signals, particularly terrestrial broadcast signals, i.e., AM and FM radio broadcasts. Recent technological advances have created a need for reception of other RF signals, such as cellular (mobile) telephone signals, Satellite Digital Audio Radio Service (SDARS) signals, and global positioning system (GPS) signals.

To receive circularly polarized signals, such as SDARS or GPS signals, patch antennas have been used. However, these patch antennas often require that radiating elements include specialized perturbation features to generate the circular polarization with practical implications which can affect antenna performance. In order to improve reliability and performance, as well as reduce cost and create more desirable aesthetics, it is desirable to have a circularly polarized patch antenna with minimal or no perturbation features. Furthermore, prior art patch antennas often include wire feed lines which must be directly connected, i.e., soldered, to the patch antenna. Soldering a feed line to the patch antenna is impractical for certain antenna implementations as well as being a labor intensive process which often results in antenna defects. Moreover, when the antenna is implemented with a vehicle window, the vibration of the window can effect solder joints as well as having other adverse effects.

SUMMARY OF THE INVENTION AND ADVANTAGES

The subject invention is an antenna for receiving and/or transmitting a circularly polarized RF signal. The antenna includes a first radiating patch and a second radiating patch. The second radiating patch is disposed generally parallel to and non-planar with the first radiating patch. A feeding element is disposed between the radiating patches for feeding RF signals from and/or to the radiating patches via electromagnetic coupling. An elongated axis is defined along a longest length of each of the radiating patches. The elongated axis of the first radiating patch is disposed at about a 90 degree angle with respect to the elongated axis of the second radiating patch.

The antenna may be integrated with a window by disposing the first radiating patch on a nonconductive pane.

By utilizing patches with elongated axes disposed perpendicular to one another, the CP antenna achieves circular polarization without the need for perturbation features. This improves aesthetics of the antenna and may assist in manufacturing efforts. Furthermore, by utilizing electromagnetic coupling to feed the patches of the CP antenna, installation of the CP antenna on a nonconductive pane becomes markedly simpler and more reliable over prior art antennas where a wire feed line must be soldered to a radiating patch.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 6 is a chart showing the magnitude of the reflection coefficient of the CP antenna;

FIG. 9 is a top view of the LP antenna;

DETAILED DESCRIPTION

Figure 1:
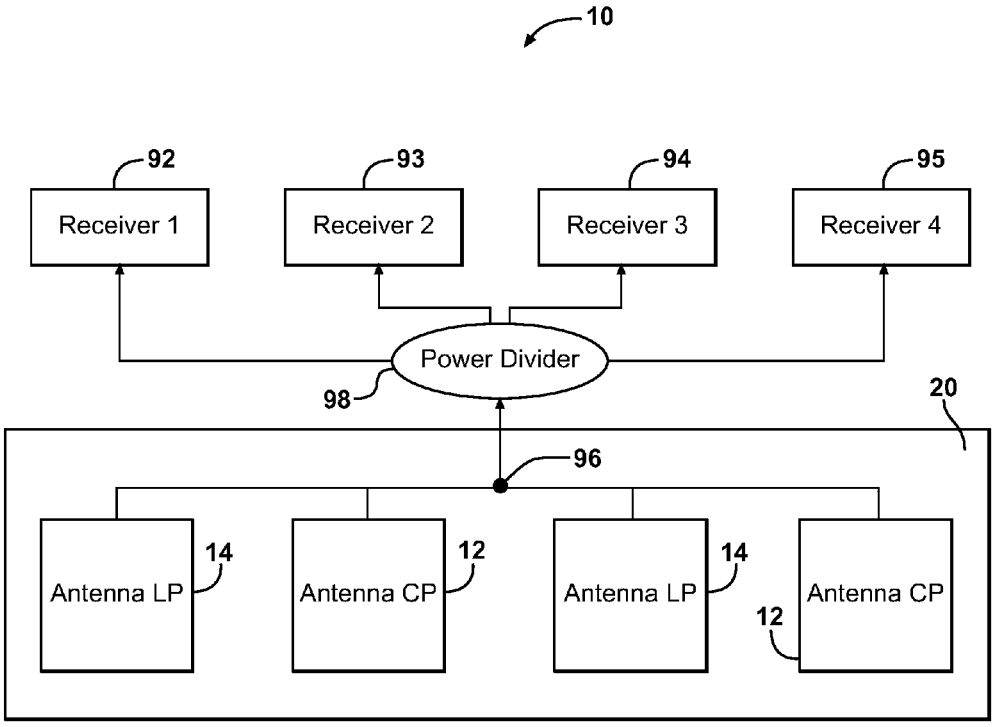
FIG. 1 is a block diagram of a first embodiment of an antenna system having circularly polarized (CP) antennas and linearly polarized (LP) antennas disposed on a nonconductive pane and electrically connected through a single port.
Figure 2:
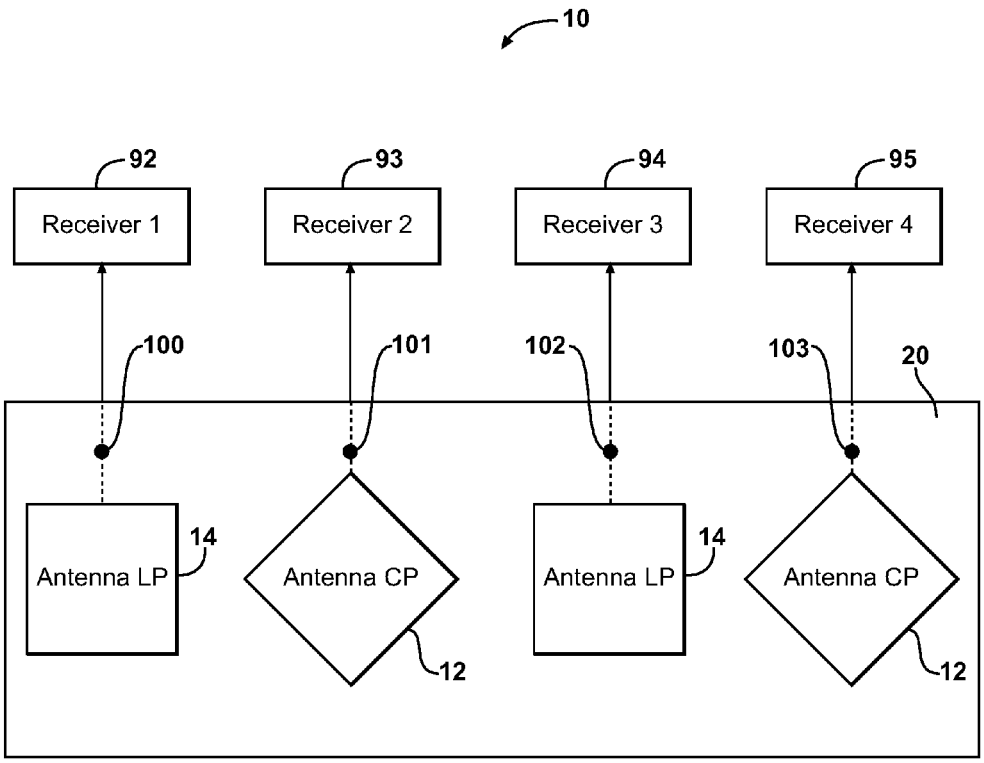
FIG. 2 is a block diagram of a second embodiment of the system with each antenna electrically connected through a separate port.

Referring to the Figures, wherein like numerals indicate like parts throughout the several views, an antenna system 10 is shown herein. Referring to FIGS. 1 and 2, the antenna system 10 preferably includes both a circularly polarized (CP) antenna 12 and a linearly polarized (LP) antenna 14 as described in greater detail below. However, the CP antenna 12 and LP antenna 14 may also be implemented separately from one another outside of the system 10. It is further preferred that the system 10 include a plurality of CP antennas 12 and LP antennas 14. However, for ease in description, the CP antenna 12 and the LP antenna 14 may be described in the singular tense herein.

Figure 3:
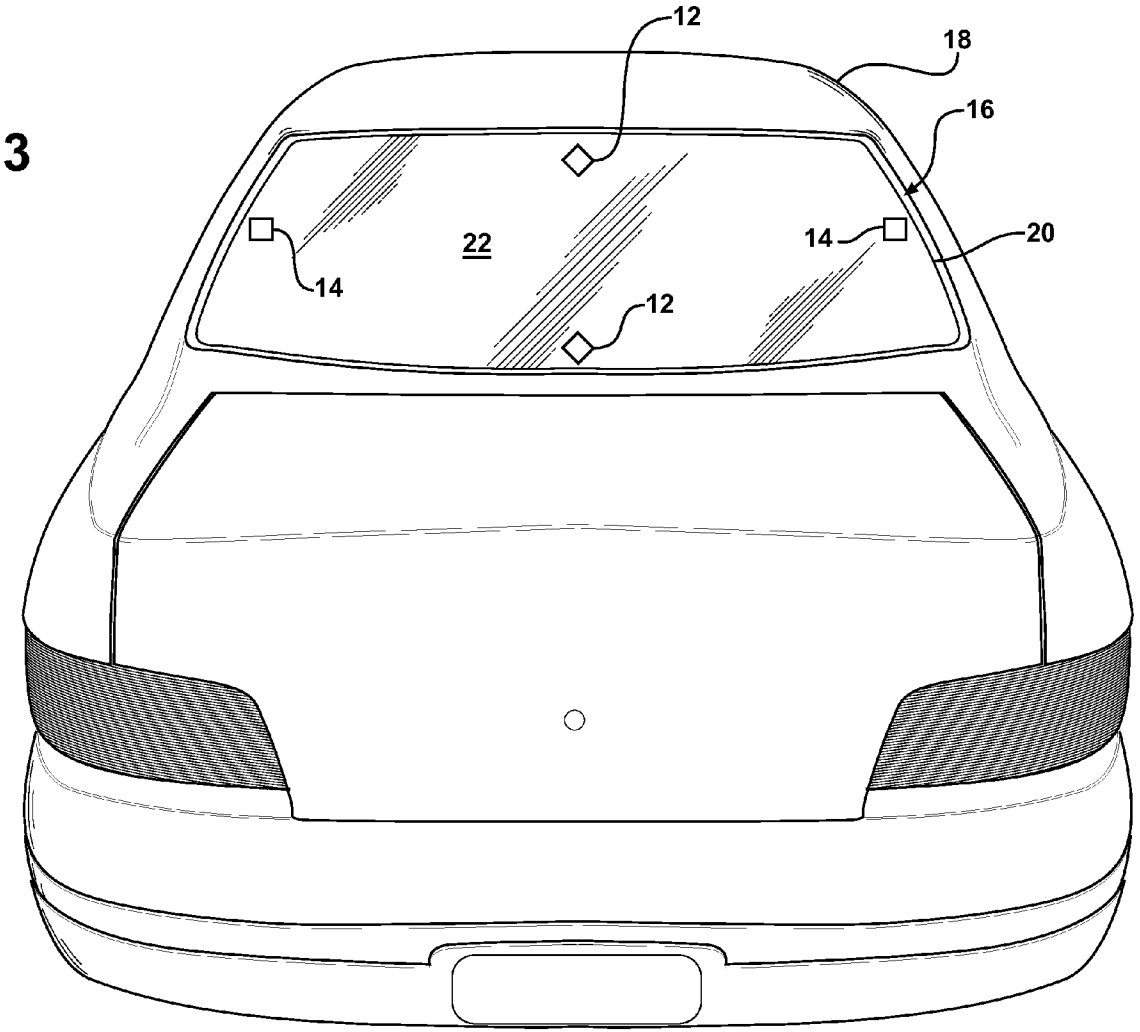
FIG. 3 is a perspective view of a vehicle having a window supporting both CP and LP antennas.

Referring to FIG. 3, the antennas 12, 14 are preferably integrated with a window 16 of a vehicle 18. This window 16 may be a rear window 16 (backlite), a front window 16 (windshield), or any other window 16 of the vehicle 18. The antennas 12, 14 may also be implemented in other situations completely separate from the vehicle 18, such as on a building. The window 16 of the illustrated embodiment includes at least one nonconductive pane 20. The term "nonconductive" refers to a material, such as an insulator or dielectric, that when placed between conductors at different potentials, permits only a small or negligible current in phase with the applied voltage to flow through the material. Typically, nonconductive materials have conductivities on the order of nanosiemens/meter.

In the illustrated embodiment, the nonconductive pane 20 is implemented as at least one pane of glass 22. Of course, the window 16 may include more than one pane of glass 22. Those skilled in the art realize that automotive windows 12, particularly windshields, may include two panes of glass sandwiching a layer of polyvinyl butyral (PVB).

The pane of glass 22 is preferably automotive glass and more preferably soda-lime-silica glass. The pane of glass 22 defines a thickness between 1.5 and 5.0 mm, preferably 3.1 mm. The pane of glass 22 also has a relative permittivity between 5 and 9, preferably 7. Those skilled in the art, however, realize that the nonconductive pane 20 may be formed from plastic, fiberglass, or other suitable nonconductive materials.

Figure 4:
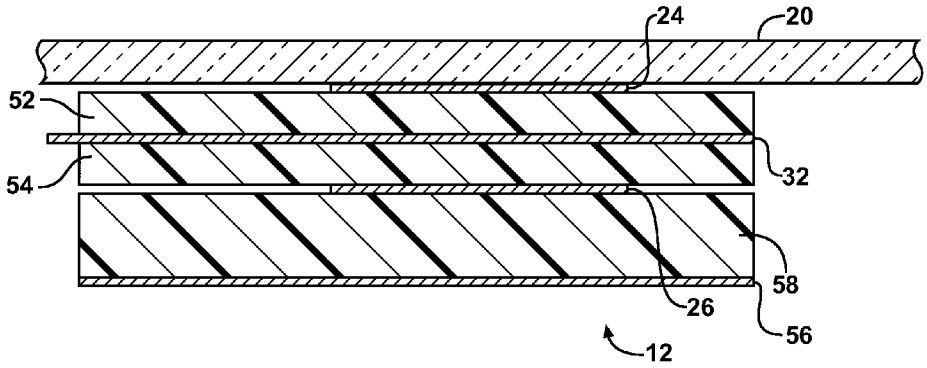
FIG. 4 is a cross-sectional view of one of the CP antennas.
Figure 8:
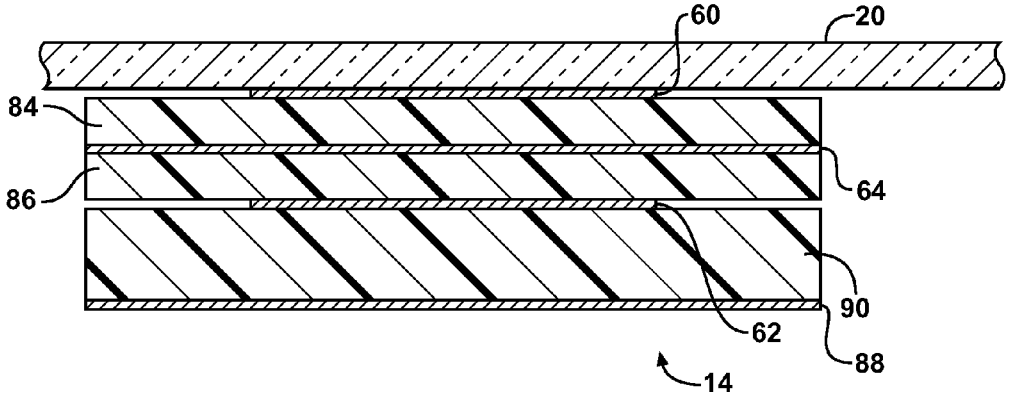
FIG. 8 is a cross-sectional view of one of the LP antennas.

Referring now to FIGS. 3, 4, and 8, the nonconductive pane 20 functions as a radome to the antennas 12, 14. That is, the nonconductive pane 20 protects the other components of the antennas 12, 14, as described in detail below, from moisture, wind, dust, etc. that are present outside the vehicle 18.

The CP antenna 12 is preferably utilized to receive a CP radio frequency (RF) signal. However, those skilled in the art realize that the CP antenna 12 may also be used to transmit the CP RF signal. Specifically, the illustrated embodiment of the CP antenna 12 receives a right-hand circularly polarized (RHCP) RF signal like that produced by the GPS. However, it is to be understood that the CP antenna 12 may also receive a left-hand circularly polarized (LHCP) RF signal, such as those produced by a SDARS provider, such as Sirius XM Radio. Furthermore, the CP antenna 12 may alternatively be used to transmit and/or receive a linearly polarized RF signal.

Figure 5:
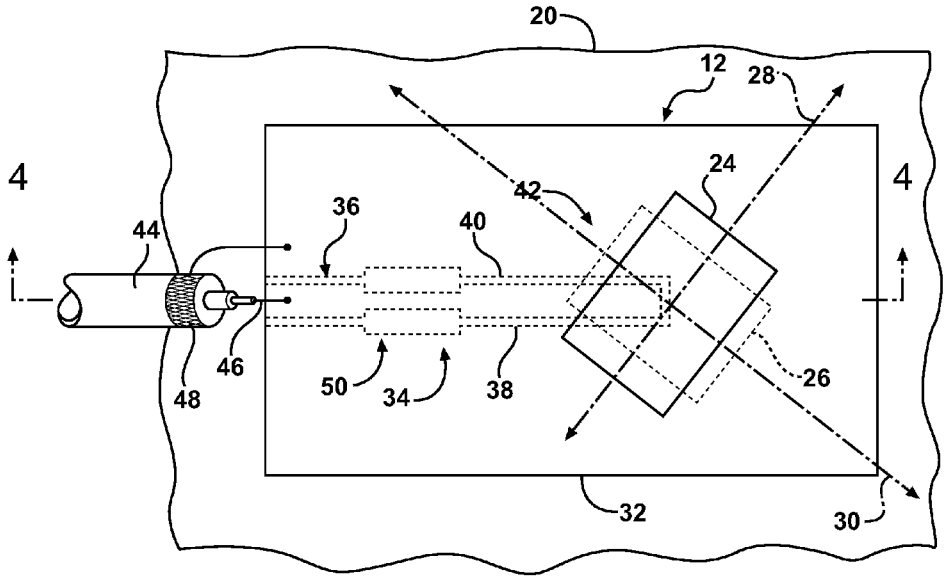
FIG. 5 is a top view of the CP antenna showing the angular relationship between conductive patches.

Referring to FIGS. 4 and 5, the CP antenna 12 includes a first radiating patch 24 formed of a conductive material. In the illustrated embodiment, the first radiating patch 24 is disposed on the nonconductive pane 20. The conductive material may be a silver paste that is fired and hardened to the nonconductive pane 20 using techniques well known to those skilled in the art. Furthermore, those skilled in the art may realize other techniques for implementing the first radiating patch 24. Other suitable conductive materials for implementing the first radiating patch 24 include, but are not limited to, gold, silver, copper, and aluminum.

A second radiating patch 26 is disposed generally parallel to and non-planar with the first radiating patch 24. Said another way, the second radiating patch 26 is disposed below the first radiating patch 24. The second radiating patch 26 is formed of a conductive material. Suitable conductive materials for implementing the second radiating patch 26 include, but are not limited to, gold, silver, copper, and aluminum.

In the illustrated embodiment, as shown best in FIG. 4, the second radiating patch 26 is directly below the first radiating patch 24. That is, a perpendicular axis (not shown) runs through a center (not labeled) of each radiating patch 24, 26. However, those skilled in the art realize that other relative dispositions between the patches 24, 26, such as an offset configuration, may alternatively be implemented.

The radiating patches 24, 26 of the CP antenna 12 in the illustrated embodiment each have an elongated shape. That is, a maximum length of each radiating patch 24, 26 is longer than a maximum width of each radiating patch. Furthermore, in the illustrated embodiment, the radiating patches 24, 26 have the same shape and dimensions as one another.

For purposes of further describing the spatial relationship between the radiating patches 24, 26, and as shown in FIG. 5, a first elongated axis 28 is defined along the maximum length of the first radiating patch 24 and a second elongated axis 30 is defined along the maximum length of the second radiating patch 26.

The first elongated axis 28 is disposed at about a 90 degree angle with respect to the second elongated axis 30. Said another way, the first elongated axis 28 is generally perpendicular to the second elongated axis 30. Said yet another way, the maximum length of the first radiating patch 24 is about 90 degrees offset from the maximum length of the second radiating patch 26. By disposing the radiating patches 24, 26 in this manner, the CP antenna 12 is able to generate circular polarization. However, the offset need not be precisely 90 degrees. An offset of +/−10 degrees from the 90 degree ideal may be suitable to generate the circular polarization.

In the illustrated embodiment, as shown in FIG. 5, each of the radiating patches 24, 26 has a non-square, rectangular shape. That is, the radiating patches 24, 26 have a pair of long sides (not numbered) and a pair of short sides (not numbered), where a length of the short sides is shorter than a length of the long sides. The first elongated axis 28 is generally parallel to the long sides and the second elongated axis 30 is generally parallel to the short sides. However, the radiating patches 24, 26 may have other shapes, such as, but not limited to, oval, triangular, and hexagonal.

In the illustrated embodiment, the CP antenna 12 also includes a ground plane 32 disposed between the radiating patches 24, 26. The ground plane 32 is generally parallel to, and non-planar with, each of the radiating patches 24, 26. The ground plane 32 is formed of a conductive material. Suitable conductive materials for implementing the ground plane 32 include, but are not limited to, gold, silver, copper, and aluminum.

Referring to FIG. 5, a coplanar waveguide 34 is defined as a continuous slot 36 by the ground plane 32. That is, the slot 36 is a region devoid of the conductive material of the ground plane 32. The continuous slot 36 includes a first leg 38 and a second leg 40. The legs 38, 40 are generally straight and parallel with one another. The coplanar waveguide 34 includes a feeding portion 42 which acts as a feeding element (not separately numbered) for feeding RF signals from and/or to the radiating patches 24, 26 without direct contact with the radiating patches 24, 26. That is, the RF signals are fed by electromagnetic coupling. By such electromagnetic coupling, the CP antenna 12 may be easily implemented on the nonconductive pane 20. The feeding portion 42 of the coplanar waveguide 34 is preferably disposed directly above/below the radiating patches 24, 26 such that the RF signals may be transferred effectively. Those skilled in the art may realize other techniques for implementing the feeding element, other than the coplanar waveguide 34.

In the illustrated embodiment, the legs 38, 40 are disposed at about a 45 degree angle with respect to each of the elongated axes 28, 30 of the radiating patches 24, 26. This angle of the legs 38, 40 with respect to the elongated axes 28, 30 assists in generation of the circular polarization of the CP antenna 12. However, the offset need not be precisely 45 degrees. An offset of +/−10 degrees from the 45 degree ideal may be suitable to assist in generation of the circular polarization.

A transmission line 44 is attachable to the coplanar waveguide 34 for transmitting RF signals to/from the CP antenna 12. In the illustrated embodiment, the transmission line 44 is unbalanced having a center conductor 46 surrounded by a shield 48 connectable to the coplanar waveguide 34 as shown in FIG. 5.

The coplanar waveguide 34 also preferably includes an impedance matching portion 50. Specifically, in the illustrated embodiment, the dimensions of the legs 38, 40 of the slot 36 are varied to implement the impedance matching portion 50. More specifically, a width of the impedance matching portion 50 is wider than a width of the feeding portion 42. By varying the width and/or a length of the impedance matching portion 50, the impedance of the coplanar waveguide 34 may be matched to an impedance of the transmission line 44. Importantly, by varying the slot 36 dimensions, the CP antenna 12 may be impedance matched with the transmission line 44 without using additional electric elements, such as resistors, capacitors, or inductors.

The CP antenna 12 of the illustrated embodiment also includes a first dielectric layer 52 and a second dielectric layer 54. The first dielectric layer 52 is disposed between the first radiating patch 24 and the ground plane 32 and the second dielectric layer 54 is disposed between the ground plane 32 and the second radiating patch 26.

The CP antenna 12 may also include a reflector 56 for reflecting RF signals towards at least one of the radiating patches 24, 26. In the illustrated embodiment, the reflector 56 is disposed generally parallel to, and non-planar with, the ground plane 32 and the radiating patches 24, 26. Specifically, one of the radiating patches 24, 26 is sandwiched between the reflector 56 and the ground plane 32. More specifically, as can be seen in FIG. 4, the second radiating patch 26 of the illustrated embodiment is sandwiched between the reflector 56 and the ground plane 32. The CP antenna 12 may further include a third dielectric layer 58 disposed between one of the radiating patches 24, 26 and the reflector 56.

Figure 7:
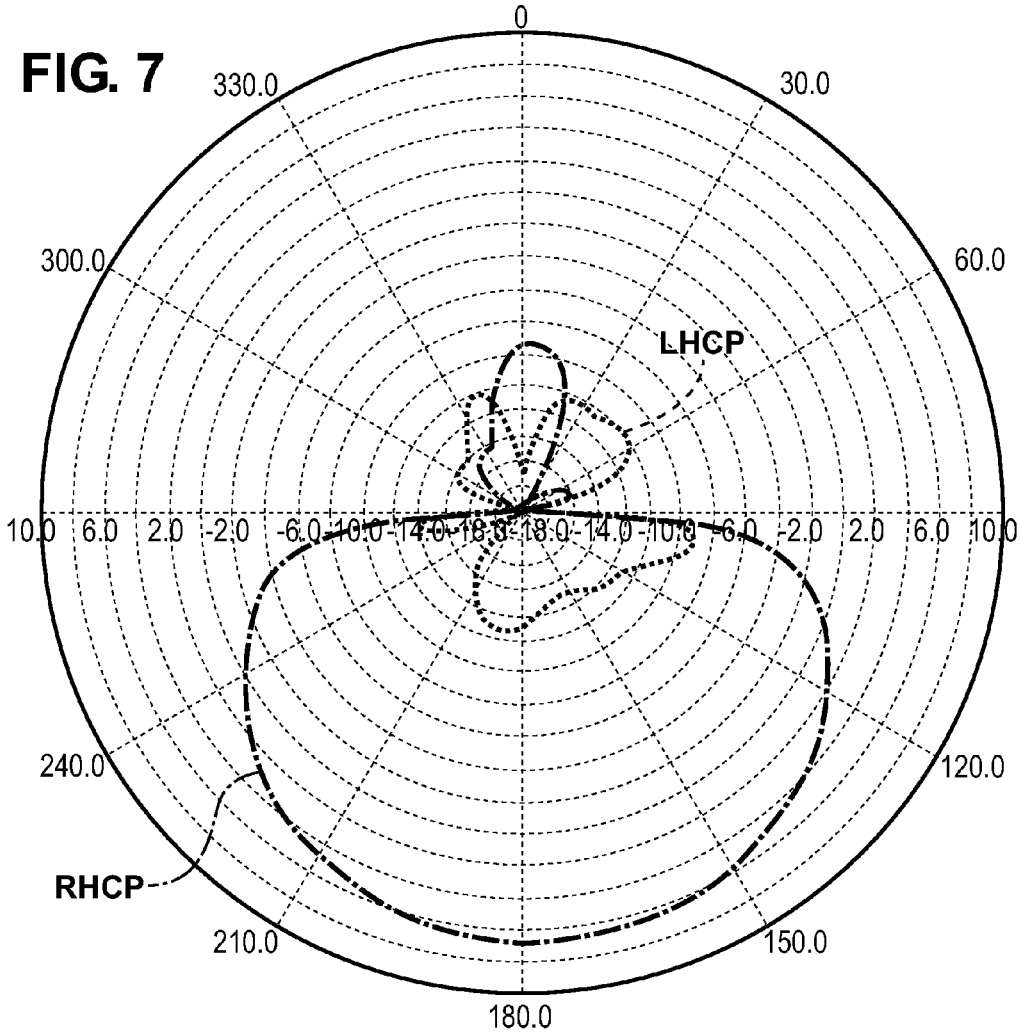
FIG. 7 is a chart showing the elevation pattern gain of the CP antenna.

FIGS. 6 and 7 show the magnitude of the reflection coefficient and elevation pattern, respectively, for the CP antenna 12 as shown in the figures and described above. As can be seen in FIG. 6, the CP antenna 12 provides an excellent magnitude of the reflection coefficient of at least −19 dB, i.e., a return loss of 19 dB, at a desired operating frequency.

Referring now to FIGS. 8 and 9, the LP antenna 14 is preferably utilized to receive a LP RF signal from a terrestrial source. The LP antenna 14 includes a first radiating patch 60 formed of a conductive material. In the illustrated embodiment, the first radiating patch 60 is disposed on the nonconductive pane 20. A second radiating patch 62, seen in FIG. 8, is disposed generally parallel to and non-planar with the first radiating patch 60. Said another way, the second radiating patch 62 is disposed below the first radiating patch 60. The second radiating patch 62 is formed of a conductive material. Suitable conductive materials for implementing the first and second radiating patches 60, 62 include, but are not limited to, gold, silver, copper, and aluminum.

The radiating patches 60, 62 of the illustrated embodiment each have a generally square shape with each radiating patch 60, 62 having the same dimensions as the other. However, those skilled in the art realize other suitable shapes may be implemented. Also in the illustrated embodiment, the LP antenna 14 also includes a ground plane 64 disposed between the radiating patches 60, 62. The ground plane 64 is generally parallel to, and non-planar with, each of the radiating patches 60, 62. The ground plane 64 is formed of a conductive material. Suitable conductive materials for implementing the ground plane 64 include, but are not limited to, gold, silver, copper, and aluminum.

Referring to FIG. 9, a coplanar waveguide 66 is defined as a continuous slot 68 by the ground plane 64. The continuous slot 68 includes a first leg 70 and a second leg 72. The legs 70, 72 are generally straight and parallel with one another. The coplanar waveguide 66 includes a feeding portion 74 which acts as a feeding element (not separately numbered) for feeding RF signals from and/or to the radiating patches 60, 62 without direct contact with the radiating patches 60, 62. That is, the RF signals are fed by electromagnetic coupling. By such electromagnetic coupling, the LP antenna 14 may be easily implemented on the nonconductive pane 20. The feeding portion 74 of the coplanar waveguide 66 is disposed directly above/below the radiating patches 60, 62 such that the RF signals may be transferred effectively. Those skilled in the art may realize other techniques for implementing the feeding element, other than the coplanar waveguide 66. In the illustrated embodiment, the legs 70, 72 are disposed at about a 90 degree angle with respect to sides (not numbered) of the radiating patches 60, 62.

A transmission line 76 is attachable to the coplanar waveguide 66 for transmitting RF signals to/from the LP antenna 14. In the illustrated embodiment, the transmission line 76 is unbalanced having a center conductor 78 surrounded by a shield 80 connectable to the coplanar waveguide 66 as shown in FIG. 9.

The coplanar waveguide 66 also preferably includes an impedance matching portion 82. Specifically, in the illustrated embodiment, the dimensions of the legs 70, 72 of the slot 68 are varied to implement the impedance matching portion 82. More specifically, a width of the impedance matching portion 82 is wider than a width of the feeding portion 74. By varying the width and/or a length of the impedance matching portion 82, the impedance of the coplanar waveguide 66 may be matched to an impedance of the transmission line 76.

Referring again to FIG. 8, the LP antenna 14 of the illustrated embodiment also includes a first dielectric layer 84 and a second dielectric layer 86. The first dielectric layer 84 is disposed between the first radiating patch 60 and the ground plane 64 and the second dielectric layer 86 is disposed between the ground plane 64 and the second radiating patch 62.

The LP antenna 14 may also include a reflector 88 for reflecting RF signals towards at least one of the radiating patches 60, 62. In the illustrated embodiment, the reflector 88 is disposed generally parallel to, and non-planar with, the ground plane 64 and the radiating patches 60, 62. Specifically, one of the radiating patches 60, 62 is sandwiched between the reflector 88 and the ground plane 64. More specifically, as can be seen in FIG. 8, the second radiating patch 62 of the illustrated embodiment is sandwiched between the reflector 88 and the ground plane 64. The LP antenna 14 may further include a third dielectric layer 90 disposed between one of the radiating patches 60, 62 and the reflector 88.

Figure 10:
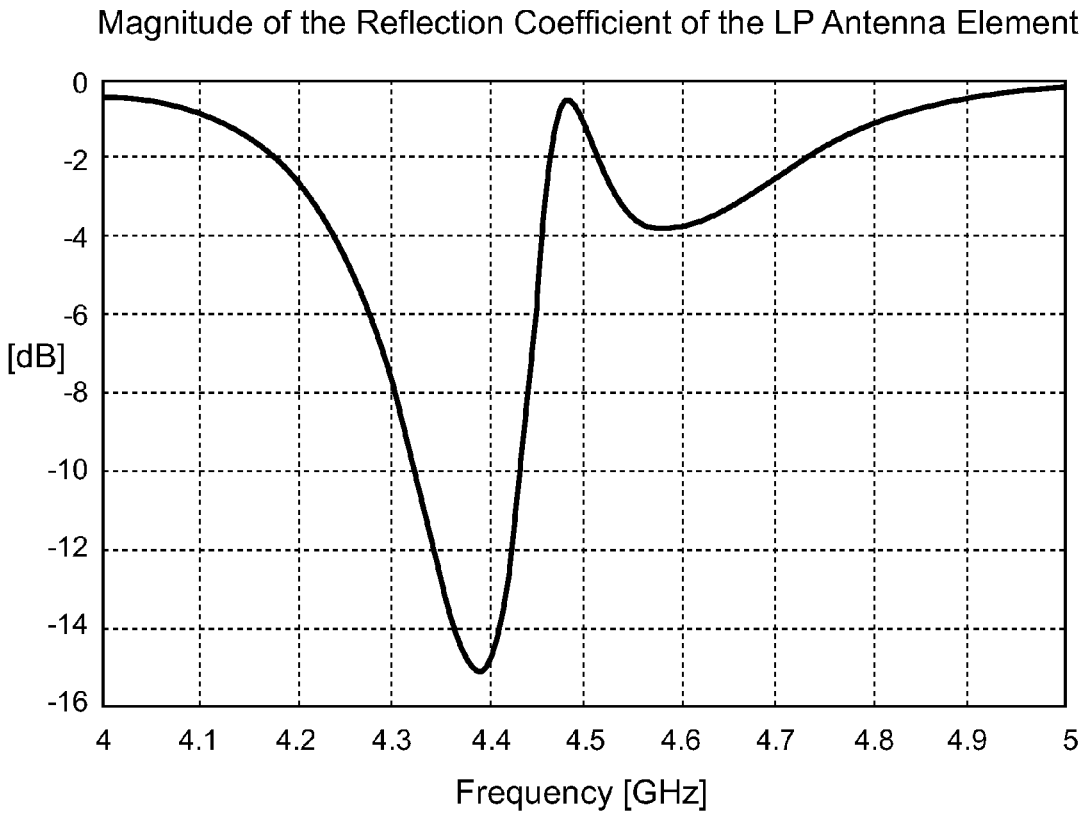
FIG. 10 is a chart showing the magnitude of the reflection coefficient of the LP antenna.
Figure 11:
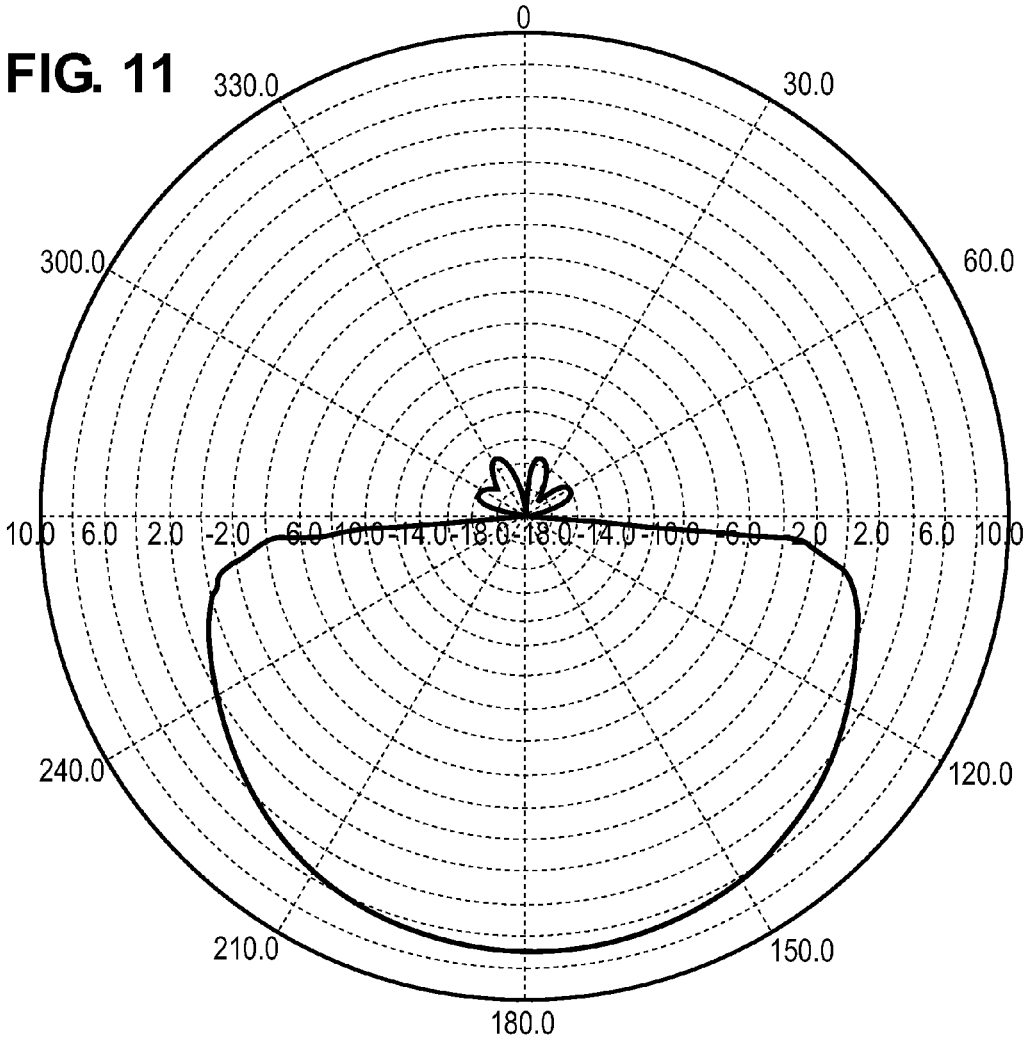
FIG. 11 is a chart showing the elevation pattern gain of the LP antenna.

FIGS. 10 and 11 show the magnitude of the reflection coefficient and elevation pattern, respectively, for the LP antenna 14 as shown in the figures and described above. As can be seen in FIG. 10, the LP antenna 14 provides an excellent magnitude of the reflection coefficient of at least −15 dB, i.e., a return loss of 15 dB, at a desired operating frequency.

Figure 12:
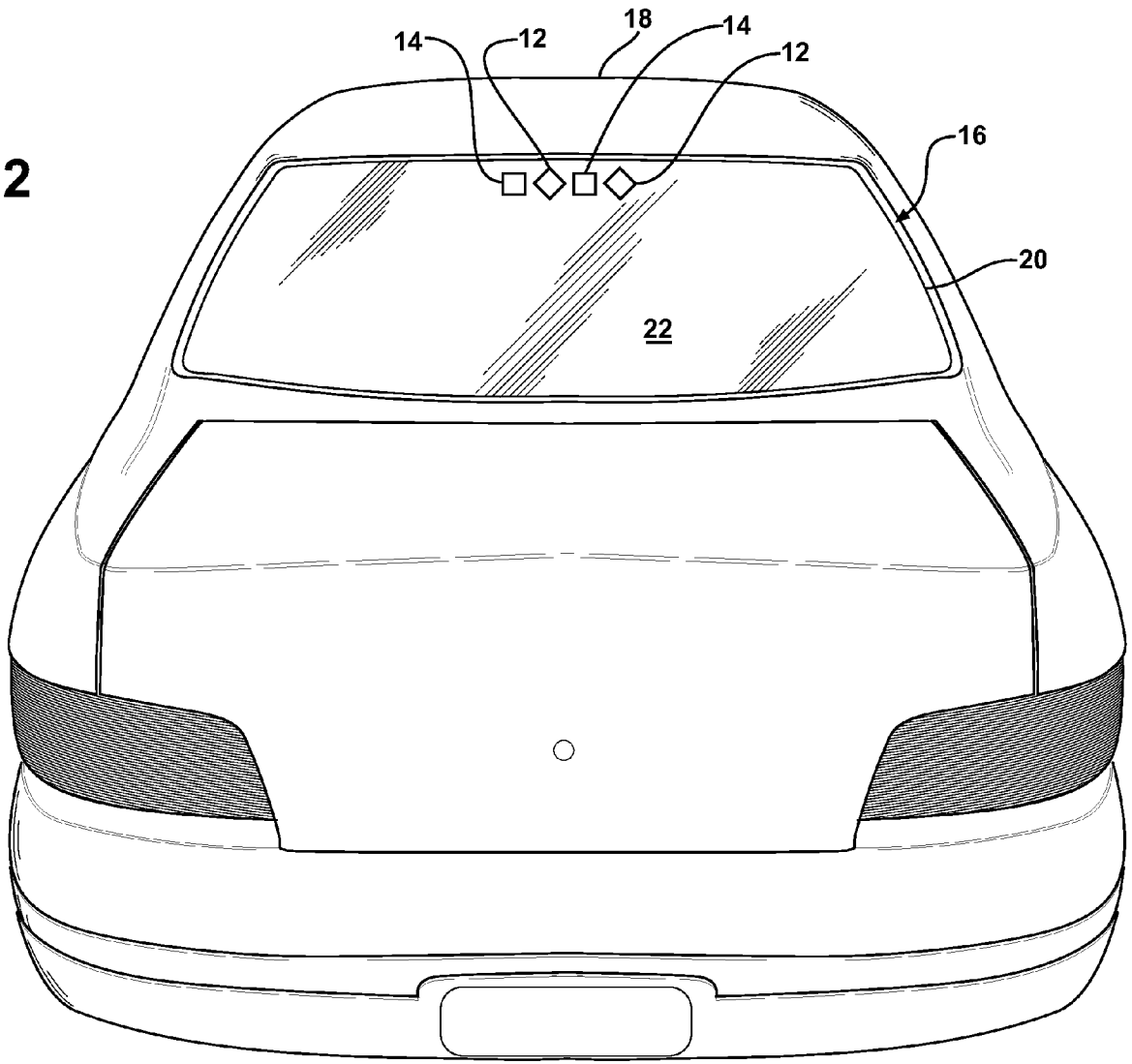
FIG. 12 is a perspective view of a vehicle having a window supporting both CP and LP antennas that share common structures.
Figure 13:
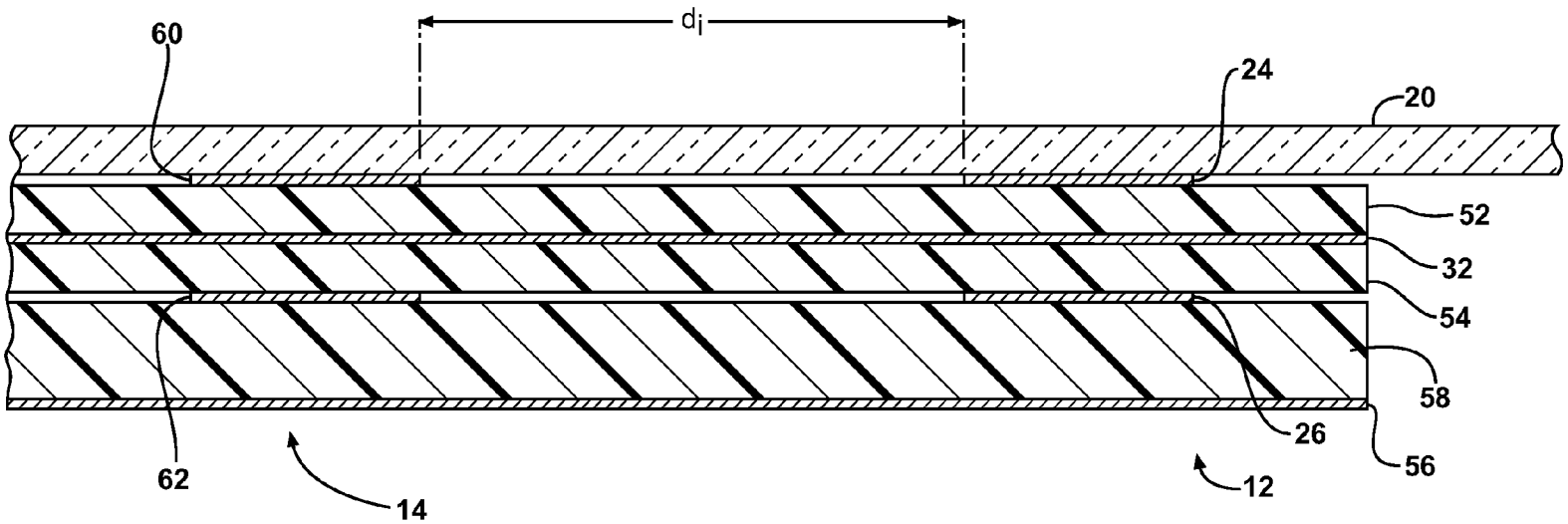
FIG. 13 is a cross-sectional view of one of the CP antennas and one of the LP antennas that share common structures.

Referring to FIGS. 12 and 13, the CP and LP antennas 12, 14 may be integrated together to share common structures (not separately numbered). For example, as shown in FIG. 13, the CP and LP antennas 12, 14 utilize the same ground plane 32, reflector 56, and dielectric layers 52, 54, 58, while having radiating patches 24, 26, 60, 62 that are independent to each antenna 12, 14. The common ground plane 32 defines independent coplanar waveguides 34, 66 for each respective antenna 12, 14.

To maintain suitable performance, a distance $d_i$ between each antenna 12, 14 is preferably at least half the wavelength $\lambda$ of the minimum operating frequency that is desired. That is, $d_i \geq \lambda_{max}/2$. However, smaller distances $d_i$ may be achieved by properly considering coupling effects between the antennas 12, 14, as may be realized by those skilled in the art.

The illustrated embodiments of the system 10, as shown in FIGS. 1-3 and 13, each include two CP antennas 12 and two LP antennas 14 disposed on the nonconductive pane 20. Specifically, the first radiating patches 24, 60 of the antennas 12, 14 are disposed on the nonconductive pane 20. As such, when the nonconductive pane 20 is substantially flat, then the first radiating patches 24, 60 of the antennas 12, 14 are generally coplanar with one another.

The antennas 12, 14 are in communication with at least one receiver 92, 93, 94, 95. Specifically, in the illustrated embodiments, the antennas 12, 14 are in communication with a first receiver 92, a second receiver 93, a third receiver 94, and a fourth receiver 95. Of course, those skilled in the art realize that the number of receivers may be modified based on various factors without departing from the scope of the invention.

In a first embodiment, as shown in FIG. 1, the four antennas 12, 14 are electrically connected to a single port 96. As such, the RF signals received from the various antennas 12, 14 are combined into a combined RF signal and available at the single port 96. The single port 96 is electrically connected to a power divider 98, also referred to by those skilled in the art as a "splitter". The power divider 98 of the first embodiment has four outputs (not numbered) to separate the combined RF signal into four RF signals: a first RF signal, a second RF signal, a third RF signal, and a fourth RF signal. The power divider 98 is also electrically connected to each of the receivers 92, 93, 94, 95 such that the first receiver 92 receives the first RF signal, the second receiver 93 receives the second RF signal, and so on. Of course, in other embodiments, the power divider 98 may have any number of outputs based on the number of receivers.

In a second embodiment, as shown in FIG. 2, each of the four antennas 12, 14 is electrically connected to an independent port. That is, one LP antenna 14 is electrically connected to a first port 100, one CP antenna 12 is electrically connected to a second port 101, another LP antenna 14 is electrically connected to a third port 102, and another CP antenna 12 is electrically connected to a fourth port 103. Each of the ports 100, 101, 102, 103 is electrically connected to one of the receivers 92, 93, 94, 95 for receiving the RF signal from one antenna 12, 14. Particularly, the RF signals from each antenna 12, 14 are not commingled together, but are isolated from one another.

The present invention has been described herein in an illustrative manner, and it is to be understood that the terminology which has been used is intended to be in the nature of words of description rather than of limitation. Obviously, many modifications and variations of the invention are possible in light of the above teachings. The invention may be practiced otherwise than as specifically described within the scope of the appended claims.

What is claimed is:

1. A window having integrated antennas for receiving and/or transmitting a RF signal, said window comprising:

a nonconductive pane;

a CP antenna for receiving and/or transmitting circularly polarized RF signals, said CP antenna including a first radiating patch disposed on said nonconductive pane, a second radiating patch disposed generally parallel to and non-planar with said first radiating patch, and a feeding element disposed between said radiating patches for feeding RF signals from and/or to said radiating patches via electromagnetic coupling, wherein an elongated axis is defined along a longest length of each of said radiating patches, and wherein said elongated axis of said first radiating patch is disposed at about a 90 degree angle with respect to said elongated axis of said second radiating patch;

an LP antenna for receiving and/or transmitting linearly polarized RF signals, said LP antenna including a first radiating patch disposed on said nonconductive pane, and a second radiating patch disposed generally parallel to and non-planar with said first radiating patch;

a common ground plane disposed between said first and second radiating patches of both said CP and LP antennas; and a common reflector disposed generally parallel to and non-planar with said common ground plane and said radiating patches of both said CP and LP antennas such that one of said radiating patches of each of said CP and LP antennas is sandwiched between said common reflector and said common ground plane.

2. The window as set forth in claim 1 further comprising a common first dielectric layer disposed between said first radiating patch of both of said CP and LP antennas and said common ground plane and a common second dielectric layer disposed between said common ground plane and said second radiating patch of both of said CP and LP antennas.

3. The window as set forth in claim 2 further comprising a common third dielectric layer disposed between said one of said radiating patches of each of said CP and LP antennas and said common reflector.

4. The window as set forth in claim 1 wherein said first radiating patch of said CP antenna has a first periphery and said second radiating patch of said CP antenna has a second periphery wherein said first periphery is offset from and not aligned with said second periphery.

5. The window as set forth in claim 1 wherein each of said first and second radiating patches of said CP antenna has a non-square rectangular shape delineated by a pair of long sides and a pair of short sides wherein a length of said short sides is shorter than a length of said long sides and said long sides of said first radiating patch are disposed at about a 90 degree angle with respect to said long sides of said second radiating patch.

6. The window as set forth in claim 1 wherein each of said first and second radiating patches of said CP antenna do not have a perturbation feature.

7. The window as set forth in claim 1 wherein said feeding element is a coplanar waveguide defined by said common ground plane.

8. The window as set forth in claim 7 wherein said coplanar waveguide is a continuous slot having a first leg and a second leg defined by said common ground plane.

9. The window as set forth in claim 8 wherein said legs are disposed at about a 45 degree angle with respect to each of said elongated axes of said first and radiating patches of said CP antenna.

10. The window as set forth in claim 8 wherein said legs include a feeding portion and an impedance matching portion.

11. The window as set forth in claim 10 wherein a width of said impedance matching portion is different than a width of said feeding portion.

* * * * *